US009701151B2

(12) United States Patent
Camus et al.

(10) Patent No.: US 9,701,151 B2
(45) Date of Patent: Jul. 11, 2017

(54) SECURITY THREAD

(71) Applicant: ARJOWIGGINS SECURITY, Boulogne-Billancourt (FR)

(72) Inventors: Michel Camus, Rives-sur-Fure (FR); Pierre Doublet, Saint-Brice (FR)

(73) Assignee: ARJOWIGGINS SECURITY, Boulogne-Billancourt (FR)

( * ) Notice: Subject to any disclaimer, the term of this patent is extended or adjusted under 35 U.S.C. 154(b) by 79 days.

(21) Appl. No.: 14/134,601

(22) Filed: Dec. 19, 2013

(65) Prior Publication Data

US 2014/0103632 A1 Apr. 17, 2014

Related U.S. Application Data

(63) Continuation of application No. PCT/IB2012/053175, filed on Jun. 22, 2012.

(51) Int. Cl.

| | |
|---|---|
| ***B42D 25/00*** | (2014.01) |
| ***B42D 25/355*** | (2014.01) |
| ***B42D 25/369*** | (2014.01) |
| ***B42D 25/41*** | (2014.01) |
| ***B42D 25/21*** | (2014.01) |

(Continued)

(52) U.S. Cl.

CPC ..... *B42D 25/355* (2014.10); *B42D 25/21* (2014.10); *B42D 25/369* (2014.10); *B42D 25/373* (2014.10); *B42D 25/41* (2014.10); *B42D 25/425* (2014.10); *D21H 21/42* (2013.01); *B42D 25/475* (2014.10); *B42D 2035/20* (2013.01); *B42D 2035/44* (2013.01); *Y10T 83/0405* (2015.04)

(58) Field of Classification Search

CPC . B42D 25/355; B42D 25/369; B42D 2033/16
See application file for complete search history.

(56) References Cited

U.S. PATENT DOCUMENTS

| | | | | |
|---|---|---|---|---|
| 2005/0042449 | A1 | 2/2005 | Phillips et al. | |
| 2009/0230670 | A1* | 9/2009 | Schmid | B42D 25/369 283/85 |
| 2010/0231846 | A1* | 9/2010 | Commander | B42D 25/355 349/193 |

FOREIGN PATENT DOCUMENTS

| | | |
|---|---|---|
| EP | 0279880 A1 | 8/1988 |
| EP | 1674286 A1 | 6/2006 |

(Continued)

OTHER PUBLICATIONS

French Preliminary Search Report for FR 1155529 with a completed research date of Jan. 13, 2012.

(Continued)

*Primary Examiner* — Kyle Grabowski
(74) *Attorney, Agent, or Firm* — Jones Robb, PLLC

(57) ABSTRACT

An anti-counterfeiting security thread for incorporation into documents and banknotes. The security thread has at least two zones located respectively on either side of a separation line extending longitudinally along the thread. Two optically variable security elements having different appearances are disposed in the first zone and second zones of the security thread. The optically variable elements are arranged with respect to the separation line so that each of the two optically variable elements has a first perceived appearance from a first direction of observation and a second perceived appearance from a second direction of observation, wherein the first and the second perceived appearances are different.

25 Claims, 6 Drawing Sheets

(51) Int. Cl.

| | |
|---|---|
| ***B42D 25/425*** | (2014.01) |
| ***B42D 25/373*** | (2014.01) |
| ***D21H 21/42*** | (2006.01) |
| *B42D 25/475* | (2014.01) |

(56) References Cited

FOREIGN PATENT DOCUMENTS

| | | | | |
|---|---|---|---|---|
| EP | 1819525 | B1 | | 3/2010 |
| EP | 2174796 | A1 | | 4/2010 |
| FR | 2877609 | A1 | | 5/2006 |
| GB | 2438384 | A | | 11/2007 |
| JP | 06286381 | A | * | 10/1994 |
| WO | 2004106078 | A1 | | 12/2004 |
| WO | 2005106601 | A2 | | 11/2005 |
| WO | 2008017869 | A1 | | 2/2008 |

OTHER PUBLICATIONS

Translation of French Preliminary Search Report for FR 1155529 with a completed research date of Jan. 13, 2012.
International Search Report and Written Opinion for PCT/IB2012/053175 (filed: Jun. 22, 2012) with a priority date of Jun. 23, 2011; Applicant: Arjowiggins Security.
Translation of International Search Report and Written Opinion for PCT/IB2012/053175 (filing date: Jun. 22, 2012) with a priority date of Jun. 23, 2011; Applicant: Arjowiggins Security.

* cited by examiner

SECURITY THREAD

CROSS REFERENCE TO RELATED APPLICATIONS

This application is a continuation of PCT Patent Application No. PCT/IB2012/053175, entitled "Security Thread," filed Jun. 22, 2012, which claims priority to French Patent Application No. 11/55,529 having the same title and a filing date of Jun. 23, 2011, both of which are herein incorporated by reference.

BACKGROUND OF THE INVENTION

1. Field of the Invention

The present invention relates to anti-counterfeiting devices. Specifically, it relates to security threads used in banknotes and other documents for authentication purposes.

2. Brief Description of the Related Art

Security threads are security elements very often used in banknotes to help make counterfeiting more difficult and to serve for authentication.

Numerous threads have been described, designed both to propose securities which are difficult to reproduce and also to produce an attractive visual appearance.

EP 1 819 525 B1 discloses a security element comprising flake pigments, which can be oriented under the effect of a magnetic field thereby making it possible to observe an underlying print, for a direction of observation substantially parallel to the orientation of the pigments. The security element has two zones in which the pigments are oriented differently so as to observe an appearance/disappearance of the underlying patterns when the direction of observation changes. The security element may be in the form of a thread.

SUMMARY OF THE INVENTION

It is the object of the invention to further improve the security threads, and it achieves this aim, according to a first of its aspects, by means of a security thread to be incorporated into a security document, comprising at least two zones located respectively on either side of a separation line extending longitudinally along the thread, a first optically variable security element in the first zone and a second optically variable security element in the second zone, the first and second elements both being at a distance from the separation line and arranged so that for a first direction of observation, the two elements have different appearances from one another and for a second direction of observation, different from the first, the two elements have, on the one hand, each changed appearance with regard to their appearance when observed along the first direction of observation, and, on the other hand, have different appearances from one another.

An advantageous visual effect has been obtained by placing the same optical feature close to both of the first and second elements on the thread, for example the same color, when passing from one zone to the other when the direction of observation changes. Due to their spacing, the two elements are visually separated by a neutral zone, which may be exploited to obtain additional security and/or to further improve the appearance of the thread.

The invention reduces the risk of superposition of the first and second security elements, which would have a negative effect on obtaining desired visual effects in the overlapping zone. The neutral zone between the two elements allows easier production, because it makes it possible, for example, to overcome problems of register when the security elements are made by printing.

The abovementioned separation line may be a median line, and the first and second zones may be symmetrical about said line.

The presence of an interval between the first and second elements, in addition to facilitating the fabrication of the thread, further serves, if necessary, to place a third security element on the thread.

Said third element may extend longitudinally and may be located visually at least partially between the first and second optically variable elements. The third element serves to raise the security level of the security thread in addition to serving as a tolerance zone for the production of the abovementioned two elements.

The third element may have a first, second or third level security feature.

"First level security" means a security detectable by the human eye, in daylight or in artificial light, unaided by a particular apparatus.

Other types of additional security element are detectable only by using a relatively simple apparatus, such as a lamp emitting in the ultraviolet (UV) or the infrared (IR). These security elements may or may not be visible to the naked eye, being for example luminescent under lighting of a Wood's lamp emitting in a wavelength of 365 nm. These security elements are called second level elements.

Other types of security element require a more sophisticated apparatus for their detection. These security elements are, for example, capable of generating a specific signal when subjected, simultaneously or not, to one or more external excitation sources. The automatic detection of the signal serves to authenticate the element if need be. Said security elements comprise, for example, tracers in the form of active materials, particles or fibers, capable of generating a specific signal when said tracers are subjected to an optronic, electric, magnetic or electromagnetic excitation. These security elements are called third level elements.

The third security element may comprise, or may even consist of:

- a demetallization, particularly a demetallization which represents the same pattern as a printed pattern between the first and second optically variable zones, or at said zones, in order to constitute an element for comparison,
- a magnetic strip, creating a third level security, or
- a colored element or one having a goniochromatic, metallic, holographic effect, inter alia.

The security thread preferably has a width between 2 and 10 mm, even more preferably between 4 and 6 mm.

The neutral zone preferably has a width between 0.2 and 1.5 mm, even more preferably between 0.4 and 0.8 mm.

The third element may be superposed or may at least partially cover one of the first and second optically variable elements, when the security thread is observed from the front. The third security element may be wider than the interval between the first and second security elements.

The third element may be superposed or may at least partially cover both the first and second security elements.

The third element may extend along a continuous or discontinuous strip.

The third element may be placed on one side of a thread strip support and the first and second elements may be placed on the opposite side of the support.

The support may be made from a thermoplastic material, preferably a transparent thermoplastic material, even more preferably from polyester or PET.

The first and second security elements may comprise the same pigment, preferably reflecting, which is deposited differently on the first and second zones, in particular with a different orientation. The pigment may be magnetic or in flake form, as in patent EP 1 819 525 B1. The pigment particles may cover underlying printings or pattern elements made otherwise than by printing. The pigment particles being oriented, a first angle of observation exists, along which the particles reflect, in which case the printed pattern or the color underneath is not visible, and a second angle of observation along which the particles are not oriented so as to reflect, and in this case the pattern or color placed underneath is visible.

The first and second optically variable elements may also each comprise a lens array.

The lenses of the lens array may or may not be suitable for observing at least one underlying pattern, according to the angle of observation.

In a particular embodiment of the invention, the security thread comprises a variable-opacity element at least partially superposed on the first and second optically variable elements, defining first and second lower-opacity zones superposed at least partially respectively with the first and second optically variable elements. The variable-opacity element may further be superposed on the third security element and may define a third lower-opacity zone at least partially superposed on the third security element, through which the third security element may be visible. The variable-opacity element may define a surrounding higher-opacity zone, extending around the first, second and third zones.

Regarding "opacity", we consider the attenuation of the intensity of an illuminant that passes through a material. The opacity of a material may vary between zero opacity (or transparency) and total opacity, in which the illuminant is not transmitted.

"Illuminant" means a light visible to the human eye, for example illuminant D65 reproducing daylight, defined by CIE Lab 1976, an infrared (IR) radiation or an ultraviolet (UV) radiation.

Regarding "variable opacity", we consider an element which, in different zones, has different properties of absorption of a predefined illuminant, in particular of visible light.

In an exemplary embodiment of the invention, for an observation in visible light, the security thread comprises a variable-opacity element obtained by metallization/demetallization. Said element comprises a surrounding higher-opacity zone corresponding to a metal layer and lower-opacity zones corresponding to openings resulting from the demetallization. In visible light, the metal layer appears to be completely opaque and the openings are transparent.

In another exemplary embodiment of the invention, for an observation under an UV or IR illuminant, the variable-opacity element comprises a print, on the higher-opacity zone, with an ink comprising a pigment that is transparent when observed in visible light but opaque when illuminated under UV or IR.

When observed in reflection along a first direction of observation through the first (respectively the second) lower-opacity zone, the first (respectively the second) optically variable element may appear transparent (respectively reflecting). When observed along a second direction of observation different from the first through the first (respectively the second) lower-opacity zone, the opposite may occur, the first (respectively the second) optically variable element appearing reflecting (respectively transparent).

The first and second optically variable elements may comprise a luminescent compound, for example fluorescent, said compound being present in one or more patterns. Thus the two steps of observation of the security thread along different angles cause the appearance in reflection of one or more colors produced by luminescence, preferably different colors, through lower-opacity zones.

The zones of the first and second optically variable elements observed respectively through the first and second lower-opacity zones may have the form of a letter and/or a text and/or a design and/or a pattern.

Preferably, the variable-opacity element extends longitudinally along a support of the security thread, and may be in the form of a strip. The higher-opacity zone may define opposite edges of said strip, which may be continuous, the lower-opacity zones extending set back from said edges.

Preferably, the width of the variable-opacity element is between 1 and 10 mm, even more preferably between 4 and 8 mm.

The variable-opacity element may be superposed completely or partially on the first and second optically variable elements.

The higher-opacity zone of the variable-opacity element may be continuous. As an alternative, it may be discontinuous. For example, it is separated into at least two distinct parts by a raster or is pixelated, so as, for example, to form a pattern in three dimensions. In the case in which the variable-opacity structure is discontinuous, the higher-opacity zone may be discontinuous at microscopic scale, while appearing substantially continuous to the naked eye. When it is formed by metallization/demetallization, its opacity is then intermediate between that of a fully demetallized zone and that of a completely metallized zone. In an example, the higher-opacity zone is pixelated (including rastered), the lower-opacity zones being devoid of pixels or raster. The higher-opacity zone may form a three-dimensional image when observed in transmitted light.

The variable-opacity element may completely or partially cover the first and second optically variable elements. The area covered by the first and second lower-opacity zones may be less extensive than the area covered by the surrounding higher-opacity zone. Preferably, the area covered by the first and second lower-opacity zones is 1.5 times, preferably 2 times, even more preferably 3 times, or even 5 times, or even 10 times, less extensive than the area covered by the surrounding higher-opacity zone.

It is thus possible to define first and second lower-opacity zones having the form of letters, a text, a pattern, a design having smaller dimensions than those of the security thread. This makes it possible in particular to focus, on these first and second lower-opacity zones, the attention of the observer who authenticates a document comprising such a security thread.

In an alternative, the area covered by the first and second lower-opacity zones may be more extensive than the area covered by the surrounding higher-opacity zone.

For example, a particular optical feature, in particular a glossy reflection effect, may pass from the first lower-opacity zone to the second lower-opacity zone with a change in the direction of observation, an optical feature of the higher-opacity zone (in particular its color) being for example preserved. A variation of the visual appearance of the first and second optically variable elements is obtained, through the first and second lower-opacity zones, by selecting the variable-opacity element appropriately. Thus, it is possible to delimit first and second lower-opacity zones having the form of a letter, a text, a pattern or a design, so that they alone have an optically variable appearance in the security thread.

In a particular embodiment of the invention, the superposition of the higher-opacity zone with the first and second optically variable elements defines fourth and fifth optically variable zones respectively, so that when observed along a first direction of observation, respectively along a second direction different from the first, the fourth optically variable zone, respectively the fifth optically variable zone, has a different visual appearance from the fifth zone, respectively from the fourth zone, and in particular appears lighter, respectively darker.

The variable-opacity element may have an opacity depending on the type of illuminant used for the observation.

The variable-opacity element may comprise of:

- a metallization/demetallization, in particular with a demetallization which represents one or more letters, a design, a pattern; in this case, the lower-opacity zones correspond to the demetallized zones and the higher-opacity zones correspond to the metallized zones; the pattern or patterns formed by the demetallized zones may also be found on the document which incorporates the security thread; this is, for example, the value of the banknote, the currency, or the name of the issuing country or bank; the metal may be selected for example from silver, aluminum, nickel, cobalt, tin, gold, copper, and from metal alloys, in particular brass or bronze; the metal may be replaced by any dielectric material; mirror- or interference-effect dielectric elements consisting of alternating high- and low-index layers, for example hafnium dioxide and silica, respectively, obtained in particular by ion etching, can be used,
- an element made from a colored material or one having a goniochromatic, metallic, holographic effect, inter alia, in order to vary the opacity of the element on predefined zones,
- an element made from a material of which the opacity may vary for example by selective application to zones defined by a heat treatment or a laser treatment,
- an element obtained by embossing, in particular hot embossing, of a material with initial uniform light absorption properties, so that the variation in opacity results from the variation in thickness caused by the embossing,
- a print with various inks, colored or not, visible to the naked eye or not, for example inks visible only under ultraviolet or infrared light, opaque in visible light, fluorescent, phosphorescent, thermochromic, photochromic, translucent and/or transparent,
- an element comprising a pixelated image, including rastered, producing a visual effect of depth when observed in transmitted light, such as, for example, that described in EP-A-1674286.

The image may represent a portrait, an animal, a landscape, a symbol, in particular alphanumeric, a line, a guilloche. It may comprise a set of points appearing more or less distant, when observed in transmitted light. These points may have various shapes and/or sizes, with optionally a specific frequency modulation. For example, the points may be in square, round, diamond or elongated form, such as a line, and may form a raster. The points may be aligned in lines inclined at specific angles, with a specific frequency modulation. The points may define positive and/or negative images. The pixelated image may comprise points observable under ultraviolet (UV) and/or infrared (IR) radiation. These points may contain pigments visible under UV or IR radiation and invisible in daylight. The pixelated image may contain points which, at least partially, represent coded data, in particular in matrix form. For example, the code may be related to the spatial position of the points and/or the opacities and/or the sizes and/or the shapes and/or the thicknesses and/or the colors of said points. The pixelated image consists of at least one material selected from metals, alloys, metallic varnishes and inks, varnishes and inks having a metallic appearance. The points are preferably applied to the support of the security thread and/or to the optically variable elements by printing and/or by techniques of partial metallization and/or demetallization. The pixelated image may be produced in a plurality of layers, applied to the support of the security thread and/or to the first and second optically variable elements, and preferably have various optical densities. Thus, these various layers with various optical densities produce a pattern, symbols, letters, lines which define a visual effect of depth when observed in transmitted light. Other layers having optical and/or magnetic and/or electrical properties described in EP-A-1674286 may be present.

Regarding "visual effect of depth", we consider a visual effect whereby various elements defining a planar image, in particular pixels of the image, appear more or less distant to the observer due to a perspective effect. For example, a trademark or an image consisting of a raster or of points appears as a three-dimensional trademark or image when viewed in transmitted light.

Preferably, the abovementioned third lower-opacity zone corresponds to an opening in the variable-opacity element. It may also be defined by a region in a transparent material of the variable-opacity element through which an illuminant, in particular visible light, is transmitted.

The third element may also be superposed or overlapped, in particular completely, by the higher-opacity zone. In a particular embodiment, it is invisible to the observer in visible light and it is detected under another illuminant, for example an ultraviolet (UV) or infrared (IR) radiation.

The third element may be placed on one side of the support and the first and second elements may be placed on the opposite side of the support.

In an exemplary embodiment of the invention in which the security thread comprises a variable-opacity element and is placed in a security document, the color difference $\Delta E$ in the CIE Lab colorimetric space between the region of the document which extends around the security thread and the variable-opacity element is lower than 5, preferably lower than 2. Thus, the color of the variable-opacity element is close to that of the document around the security thread. In this case, along at least one angle of observation, the security thread cannot be visually distinguished from the region of the document adjacent to the security thread. Along another angle of observation, a pattern defined by the first and/or second lower-opacity zone becomes reflecting, for example, whereas the color of the higher-opacity zone or of the document around the variable-opacity element is substantially unchanged.

The pattern or patterns defined by the lower-opacity zones of the security thread may also be found on the security document and thereby establish a link between the security document and the security thread. Preferably, in the case in which the security document is a banknote, the pattern represents for example the currency, the name of the bank or the value of the note. The first optically variable element may be made on a film in the form of spaced parallel strips and the second optically variable element may be made in the form of spaced parallel strips, interlaced with the strips formed by the first element, with a spacing between the strips of the first element and the strips of the second element, the film being cut at mid-width of the strips of the first element and the strips of the second element in order to constitute a plurality of security threads.

The strips may be made for example by printing, for example in successive passes on the film. The film may be turned over between the passes, for example by rotation about an axis perpendicular to the film surface, thereby constituting a simple and effective means for orienting the pigment particles differently, in particular in the case in which the first and second security elements consist of orientable reflecting particles.

A further object of the invention is a security document incorporating a security thread according to the invention, as defined above, the thread extending from one edge of the document to an opposite edge.

A further object of the invention is a security document comprising a substrate and a security thread comprising:

a support, a first optically variable element carried by the support, a second optically variable element carried by the support, the first and second elements having first and second regions, not superposed on the support, a variable-opacity element at least partially covering the first and second regions, defining first and second lower-opacity zones that are at least partially superposed respectively with the first and second regions and a surrounding higher-opacity zone, the security thread being placed on the substrate so that the first and second regions are visible through the variable-opacity element, the first and second elements being arranged so that for a first direction of observation, the first and second elements, when observed simultaneously through the first and second lower-opacity zones respectively, have different appearances from one another and, for a second direction of observation different from the first, the first and second elements, when observed simultaneously through the first and second lower-opacity zones respectively, have, on the one hand, changed appearance with regard to their appearance when observed along the first direction of observation, and on the other hand, have different appearances from one another.

"Security document", a synonym of "secure document", means a value document, for example a means of payment, such as a banknote, a cheque or a restaurant voucher, a lottery ticket, a transport ticket or a ticket providing access to a cultural or sports event and/or a document for identifying people, such as an identity card, a visa, a passport or a driver's license.

A further object of the invention is a method for authenticating or identifying a document comprising a security thread according to the invention, in which the change in appearance of the first and second optically variable elements is observed by modifying the direction of observation of the thread.

It is possible in particular to determine whether, when the angle of observation changes, the appearance of a zone of the thread disappears and is retrieved on another zone.

In an exemplary embodiment of the method, a security feature of the third security element, the latter then being present, is further detected.

A further object of the invention is a method for fabricating a security thread according to the invention, which may comprise a step of forming a variable-opacity element when it is present in the security thread.

More particularly, said method may comprise a step of preparing a variable-opacity element, preferably by demetallization, in particular by chemical attack, of a layer of metal covering the support and/or the first and second optically variable elements, and covered by the printing of a varnish, the latter providing protection against the chemical attack. As an alternative, a primer soluble in a solvent is applied to the support and/or to the first and second optically variable elements according to the negative of the pattern to be produced before the metallization, and said metallization is then carried out. The chemical attack solubilizes the primer and the metal leaves the support at the locations where the soluble primer is present. The metal layer is preferably deposited by vacuum metallization.

The fabrication method may also comprise a step of depositing a security thread according to the invention on the security document. When it comprises a variable-opacity element, the security thread is placed on a substrate of the security document so that the first and second optically variable elements are visible through the variable-opacity element.

DESCRIPTION OF THE DRAWINGS

The invention may be better understood on reading the detailed description which follows of an exemplary embodiment of the invention and on examining the appended drawing in which.

Figure 1:
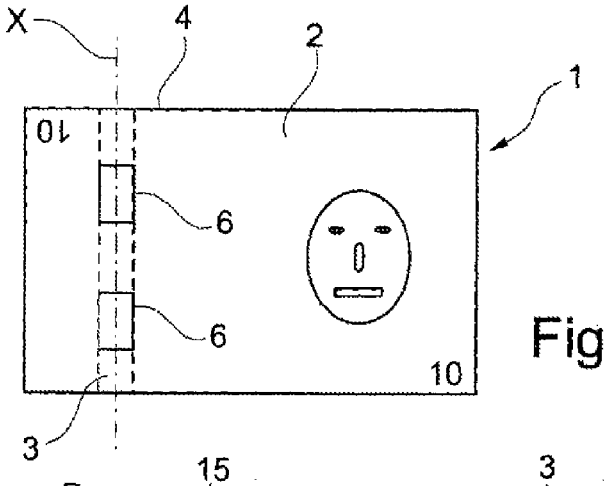
FIG. 1 shows a front view of an example of a value document according to the invention.

In the appended drawing, the actual proportions of the elements constituting the security thread, and the elements constituting the security document, are not always respected, in a concern for clarity of the drawing. Moreover, some elements are not shown in contact with one another in a concern for clarity, whereas they are so in practice.

DETAILED DESCRIPTION OF THE INVENTION

FIG. 1 shows a security document 1 according to the invention, for example a banknote, which comprises a substrate 2 and a security thread 3 according to the invention. The latter extends between two opposite edges 4 and 5 of the document 1.

The security thread 3 may be incorporated at least partially into the body of the substrate 2 of the security document, and only part of the thread 3 appears visible, for example through one or more windows 6 formed in the substrate. An example of incorporation in a window is described in document EP 59056.

Preferably, the substrate 2 of the security document incorporating the security thread 3 consists of natural fibrous materials, for example cellulose and/or cotton, and/or synthetic fibers. The substrate 2 may also be made from plastic materials, such as for example a Polyart™ film sold by ARJOBEX Ltd.

Figure 2:
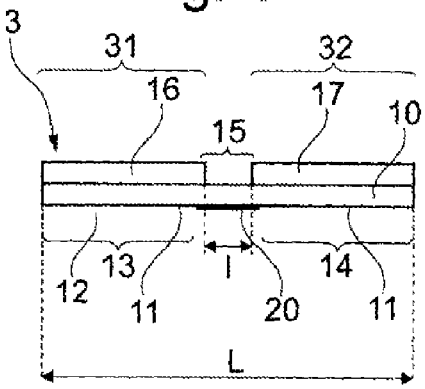
FIG. 2 shows a cross section of the isolated security thread.

FIG. 2 shows an isolated security thread 3. Said thread comprises a support 10, preferably made from a transparent thermoplastic material, for example polyester or PET.

The support 10 has a flattened cross section, in particular rectangular as shown. The thickness of the support 10 is, for example, between 8 and 30 microns, preferably between 12 and 23 microns.

Printings 11 are made on one face 12 of the support 10, in two zones 13 and 14 spaced from one another and between which an intermediate zone 15 is located.

The printings 11 are covered on the side of the opposite face 19 of the support 10 by layers, respectively 16 and 17, of reflecting flake, and magnetic, pigments each deposited in the form of a strip extending along the thread.

Figure 3:
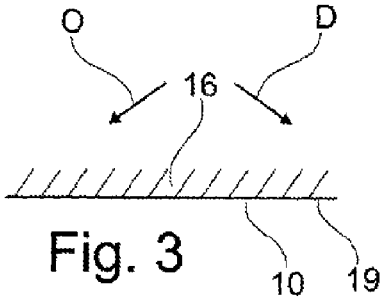
FIGS. 3 and 4 show exemplary embodiments of the optically variable zones.
Figure 4:
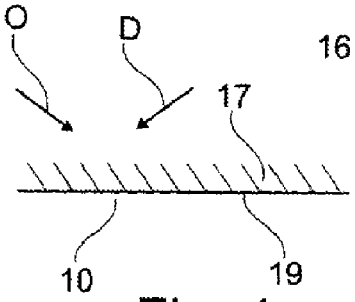

The pigments of the layers 16 and 17 are oriented differently, as shown in FIGS. 3 and 4. Thus, for a direction of observation O parallel to the orientation direction of the pigment flakes, the underlying print 11 is visible, and for a different direction of observation D, the pigment is reflecting and the underlying print 11 is not visible. Optically variable zones 31 and 32 separated by the intermediate zone 15 are thereby obtained, and, for example, the change in appearance shown in FIGS. 5 and 6 is observed when the direction of observation is modified.

Figure 5:
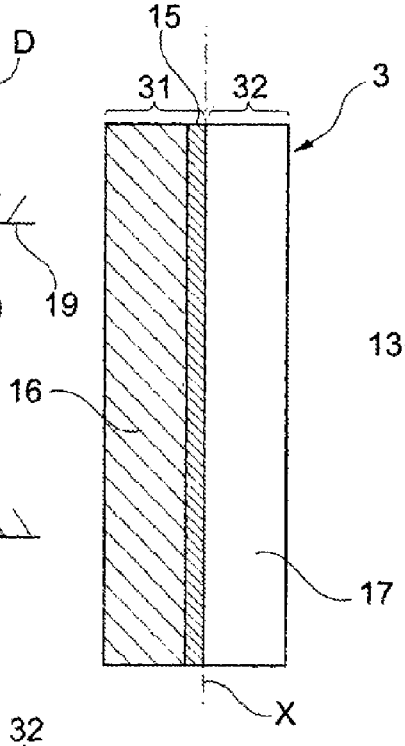
FIGS. 5 and 6 show the change in appearance of the thread during a modification of the direction of observation.
Figure 6:
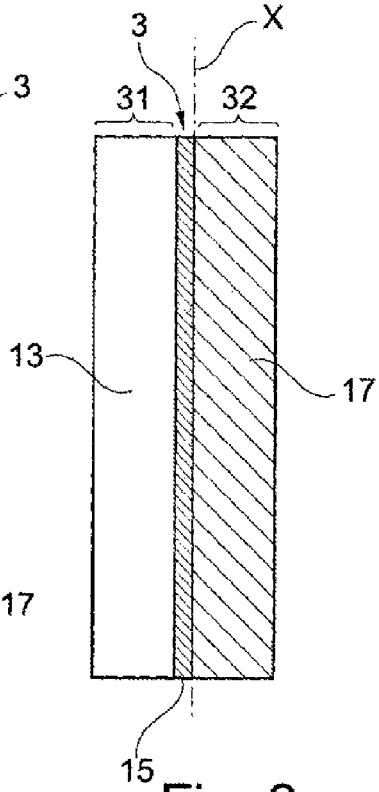

In FIG. 5, for a direction of observation, one of the zones appears to be dark and the other light. In FIG. 6, the opposite occurs.

The prints 11 may be produced directly on the support, as is the case in FIG. 2, or as an alternative, on an independent transparent layer, for example of PET, laminated by means of an adhesive on the remainder of the security thread. Thus, the thread may comprise a multilayer support.

The width L of the thread 3 is preferably between 2 and 10 mm, and the width 1 of the intermediate zone 15 is between 0.5 and 1.5 mm.

A third security element 20 is deposited between the prints 11, under the intermediate zone 15, on the face 12 of the support 10, as shown in FIG. 2. This third security element 20 may be visible from the side of the face 19, thanks to the non-opaque character of the support 10.

The third security element 20 may consist of:

- an invariable color, different from the printings 11 made in zones 13 and 14, or identical thereto,
- a magnetic tape, which may contain a magnetic code,
- a text or other patterns formed by demetallization,
- a holographic structure,
- a goniochromatic pigment or any other structure having a color change effect, or
- a thermochromic pigment.

The thread 3 may be produced in such a way that the change in appearance of the zones 31 and 32 takes place when the direction of observation rotates about an axis parallel to or merged with the median longitudinal line X of the thread 3, or as an alternative, about an axis perpendicular to said longitudinal line. The angular difference between the two directions of observation is, for example, at least 5°, or preferably 15°. The angular difference is, for example, between 5 and 50°, preferably between 15 and 20°.

The pigments are oriented according to the axis about which the direction of observation is to rotate in order to observe the desired change in appearance. For example, the pigments are oriented, the axis X being vertical, respectively to the left and to the right, to obtain the change in appearance when rotating from left to right or vice versa.

Figure 7:
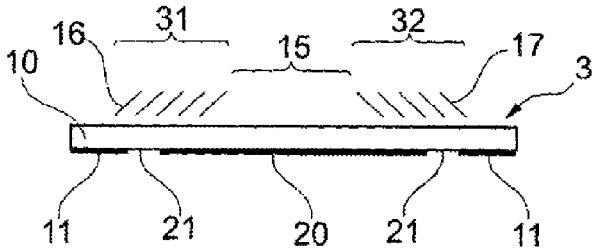
FIG. 7 is a view similar to FIG. 2 of an alternative embodiment of the thread.

FIG. 7 shows an alternative embodiment in which the layers 16 and 17 also cover the security element 20 but in which the printings 11 are spaced from the third security element 20, defining intervals 21, for example in the form of characters or strips.

In the example in FIG. 2, the element 20 is wider than the width 1 of the intermediate zone 15 made between the layers 16 and 17. As an alternative, the treatment is different, and the element 20 is for example narrower.

In an alternative, the printings 11 are made on the face 19.

In the examples in FIGS. 14 and 15, a security thread is shown as described with reference to FIG. 2, in which the optically variable elements 16 and 17 are covered by a variable-opacity element 60, for example a metallization/demetallization or a print. The first 16 and second 17 elements have first A and second B regions, not superposed on the support 10.

The variable-opacity element 60 defines first C and second E lower-opacity zones which are superposed respectively on the first 16 and second 17 optically variable elements. The variable-opacity element 60 defines a third lower-opacity zone F which is superposed on the third security element 20. A surrounding higher-opacity zone G extends around the first, second and third zones.

Figure 14:
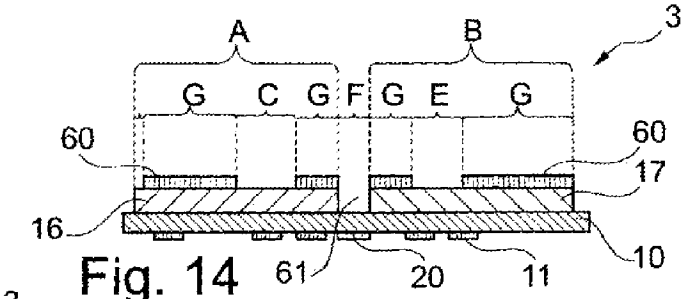

In the example in FIG. 14, the third lower-opacity zone F is obtained by means of an opening 61, for example longitudinal, made in the variable-opacity element 60. This opening 61 may separate the variable-opacity element 60 into two distinct parts.

Figure 15:
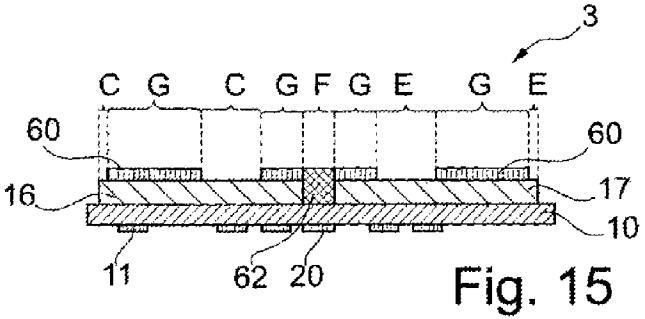
FIGS. 14, 15, 16 and 17 show, schematically and partially, in a cross section, security threads each comprising a variable-opacity element, according to various embodiments.

In the example in FIG. 15, the third security element 20 is visible through the third lower-opacity zone F, a region 62 of the material of the variable-opacity element 60 having a lower opacity than its surrounding area. Preferably, the region 62 is transparent.

Figure 16:
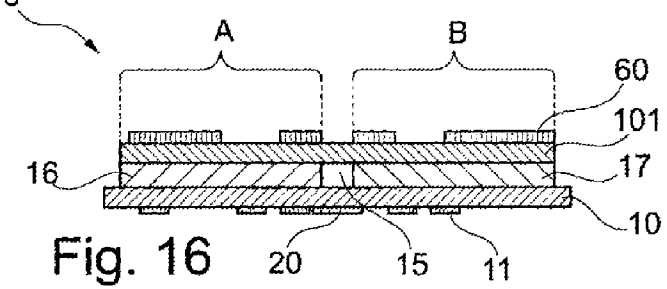

In the example in FIG. 16, a second support 101, for example made from PET, preferably transparent, is used to facilitate deposition of the variable-opacity element and to protect the optically variable elements 16 and 17. This support may facilitate the fabrication of the variable-opacity element by a metallization/demetallization method.

In an alternative not shown, the third security element 20 is placed in the interval 15 on the face of the support 10 which carries the two optically variable elements 16 and 17.

Figure 17:
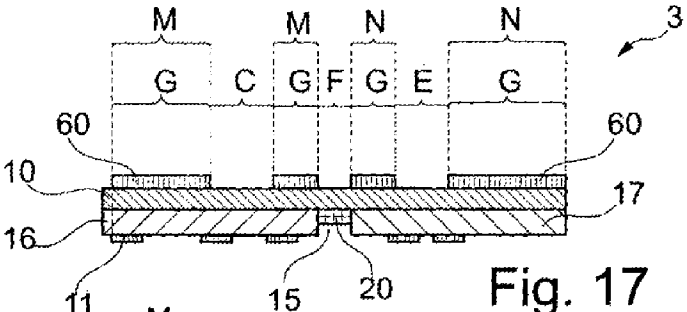

In FIG. 17, the variable-opacity element 60 and the first 16 and second 17 optically variable elements are located on respective opposite faces of the support 10.

Printings 11 may optionally be placed on the face of the support 10 opposite that where the optically variable elements 16 and 17 are placed, and may be partially or totally visible when observed through the first and second lower-opacity zones C and E, as shown in FIGS. 14 to 16.

In a particular embodiment of the invention, the higher-opacity zone G is not completely opaque and transmits part of the visible light.

As shown in FIG. 17, the superposition of the higher-opacity zone G with the first 16 and second 17 optically variable elements defines fourth M and fifth N optically variable zones respectively.

Figure 19:
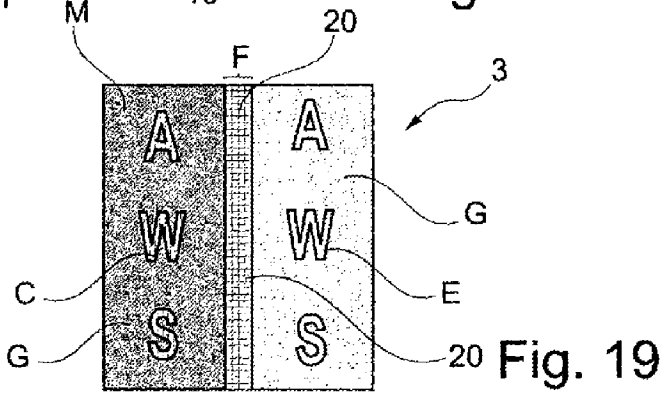
FIGS. 18 and 19 show the change in appearance of the optically variable zones on which a variable-opacity element is superposed.
Figure 18:
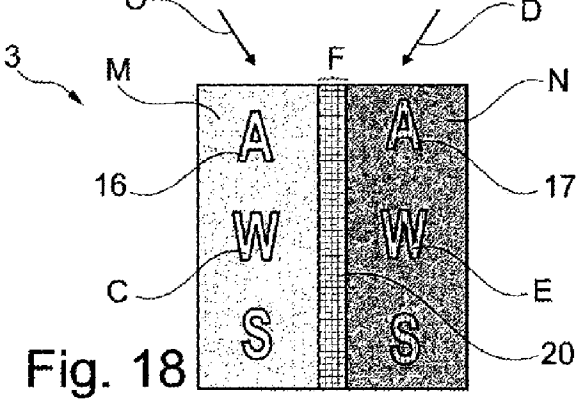

On a security thread comprising a variable-opacity element 60 as shown in FIGS. 14 to 17, modifying the angle of observation makes it possible, for example, to observe the change in appearance shown in FIGS. 18 and 19. In this example, viewed from the front, a first set consisting of the fourth optically variable zone M and the first lower-opacity zone C and a second set consisting of the fifth optically variable zone N and the second lower-opacity zone D are located on either side of the third lower-opacity zone F, through which the third security element 20 is visible.

Along a first direction of observation O shown in FIG. 18, the fourth optically variable zone M appears lighter than the fifth zone N, and the first optically variable element 16, observed through the lower-opacity zone C, appears transparent. It may then be possible to observe the underlying printings 11 if necessary. The second optically variable element 17, observed through the second lower-opacity zone E, appears reflecting.

In FIG. 19, the opposite effect to the one observed in FIG. 18 is obtained, by varying the angle of observation.

In an exemplary embodiment of the invention, the surrounding higher-opacity zone G is completely opaque, and only the first C and second E lower-opacity zones appear visually different according to the direction of observation. The fourth M and fifth N optically variable zones substantially have the same appearance, regardless of the angle of observation. The surrounding higher-opacity zone G has a visual feature, for example a color, uniform and invariable with the angle of observation. In the direction of observation O or Q, a reflecting appearance of the flake particles is only visible through one of the first C and second E lower-opacity zones.

The security thread 3 may be observed from the front in transmitted light. The security thread is then placed between a light source and the observer. The light emitted by the source passes through the security thread. In this method of observation and authentication, when observed simultaneously, the patterns defined by the lower-opacity zones C and E are partially opaque and have a substantially identical visual appearance. Preferably, for this purpose, the angles of observation of the flake particles with regard to the normal are substantially the same, in absolute value. The third and fourth optically variable zones M and N may have a substantially identical appearance. They may appear darker than the patterns defined by the lower-opacity zones C and E, because the illuminant must pass through the higher-opacity zone G.

Figure 20:
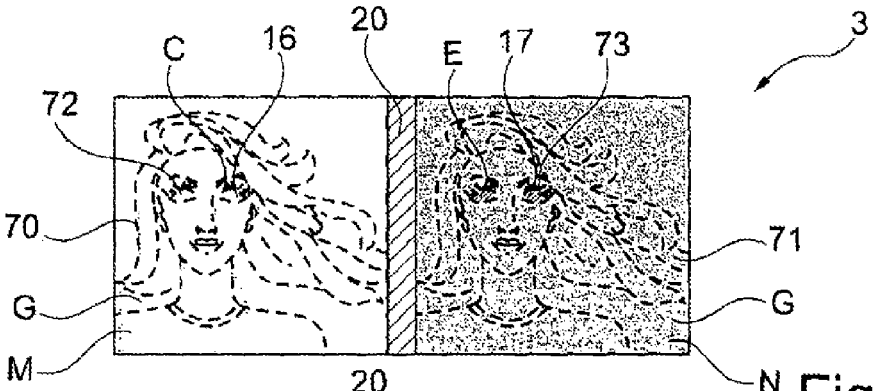
FIGS. 20, 21 and 22 show an alternative embodiment of the security thread, in which the variable-opacity element comprises a pixelated image.
Figure 21:
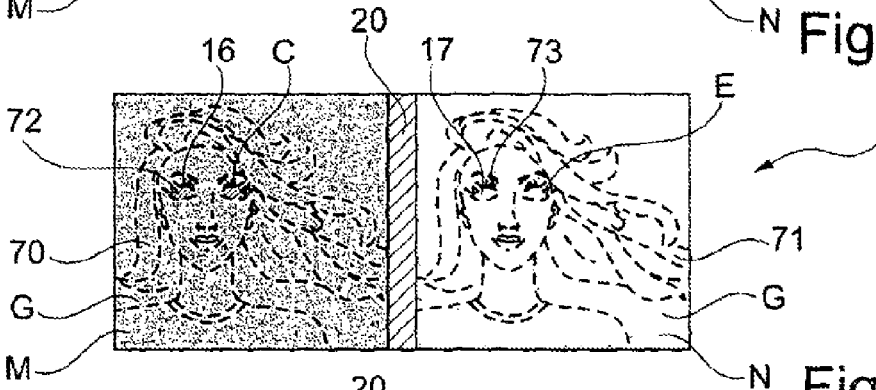
Figure 22:
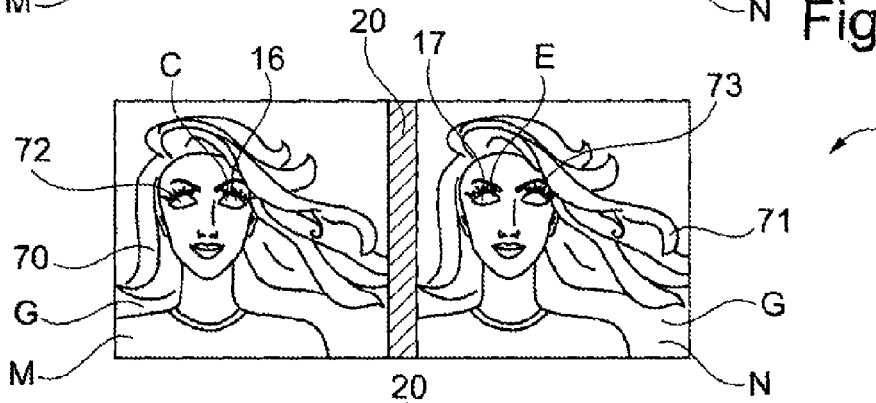

FIGS. 20, 21 and 22 show an embodiment in which the variable-opacity element 60 comprises pixelated images 70 and 71, for example disclosed in EP-A-1674286, representing for example a woman's face superposed respectively on the first 16 and second 17 optically variable elements. These images define the higher-opacity zone G.

The variable-opacity element 60 comprises first C and second E lower-opacity zones corresponding for example to openings 72 and 73, for example located at the level of the eyes of the images 70 and 71. Each of these images advantageously comprises a succession of elements, for example of points or of lines, for example of different colors, arranged in such a way that a visual effect of depth is produced, when observed in transmitted light, the elements of the pixelated image appearing more or less distant to the observer. This visual effect is for example related to the size (for example the diameter of the points or the thickness of the lines), the position or the density of the elements of the pixelated image.

When the security thread 3 is observed in reflection along direction O, the first optically variable element 16 appears transparent through the lower-opacity zone C, as shown in FIG. 20. Since the superposition of the surrounding higher-opacity zone G and the first optically variable element 16 is not completely opaque, the pixelated image 70 may appear visually in depth. Along this direction 0, the second optically variable element 17 is reflecting when observed in reflection. The eyes of the image 70 appear reflecting. No light can be transmitted through the security thread in the zone superposed on the second element 17. On this zone, the image 71 has the appearance of a planar image, and does not appear visually in depth. It further appears darker than the higher-opacity zone G superposed on the first optically variable element 17.

In FIG. 21, the opposite effect occurs, along the direction of observation Q, symmetrical about the normal.

In FIG. 22, the security thread 3 is observed from the front in transmitted light, along a direction perpendicular to the security thread. In this case, the two optically variable zones M and N, as defined for example in FIG. 17, appear visually in depth to the observer.

Figure 23:
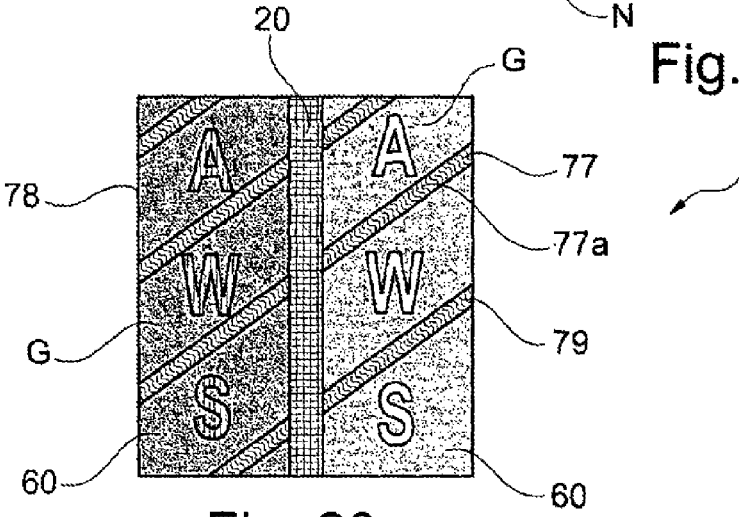
FIG. 23 shows an alternative embodiment of the security thread comprising a raster.

FIG. 23 shows the possibility for the surrounding zone G to be discontinuous at microscopic scale, comprising a raster 77 which extends for example from one edge 78 to the other 79 of the variable-opacity element and separates the variable-opacity element transversally into distinct parts. This raster may appear as being continuous when observed in reflection, the less opaque lines 77*a* being for example more numerous, narrow and closer together than shown. This raster may be pixelated and appear visually in depth when observed in transmitted light, as in the example in FIGS. 20 to 22.

In the above examples, the variable-opacity element 60 may be a metallization/demetallization, for example obtained as described in patent EP-A-279880. This variable-opacity element may also, in an alternative, be made with an ink having a low opacity, or even transparent, comprising a photosensitive pigment, for example sensitive to a laser radiation. By selectively treating the ink with the laser radiation, a higher-opacity zone is obtained. The photosensitive pigment exposed to the laser radiation modifies the optical properties of the treated zone to make it more opaque. In another alternative, the element 20 is partially deposited on the layers 16 and 17, in addition to covering the intermediate zone 15.

In the above examples, the printings 11 may be replaced by metallizations, demetallizations or other observable elements.

The optically variable elements may be made otherwise than with orientable magnetic pigments.

For example, the optically variable elements are made using lens arrays, as shown in FIGS. 8 to 11.

The lenses 30 of the lens array are, for example, cylindrical or hemispherical, concave, convex or Fresnel lenses, and are for example positioned in a hexagonal, compact hexagonal or rectangular arrangement. Compact hexagonal means an arrangement in which the lenses are included in a hexagonal shape without a space between them. Preferably, the lens array consists of coplanar hemispherical lenses placed in a zigzag arrangement, hexagonal lenses arranged in "honeycombs" or juxtaposed cylindrical lenses.

The lens array can be made by embossing, in particular by thermal embossing or by embossing followed by ultraviolet crosslinking, or by molding. The lens array may be printed and comprise lenses 30 juxtaposed or not, for example formed by UV printing, for example by screen printing, rotogravure, typography, or by inkjet printing.

A first pattern or color may be observable through the lens array along a first angle of observation in the first zone 31, a second pattern or color observable through the lens array along a second angle of observation, different from the first angle, in the second zone 32.

Figure 10:
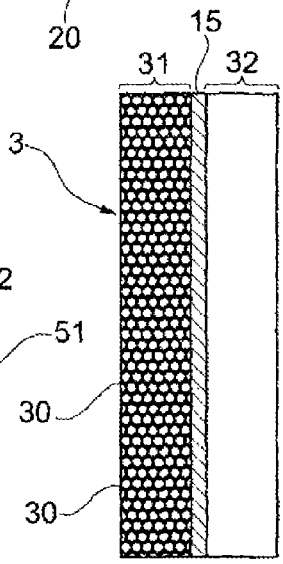
FIGS. 10 and 11 show the change in appearance of the optically variable zones with the modification of the direction of observation.
Figure 11:
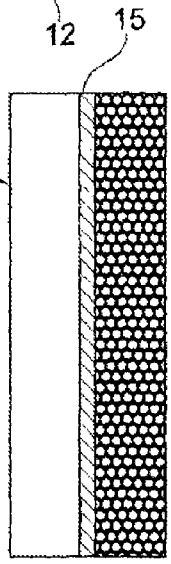
Figure 12:
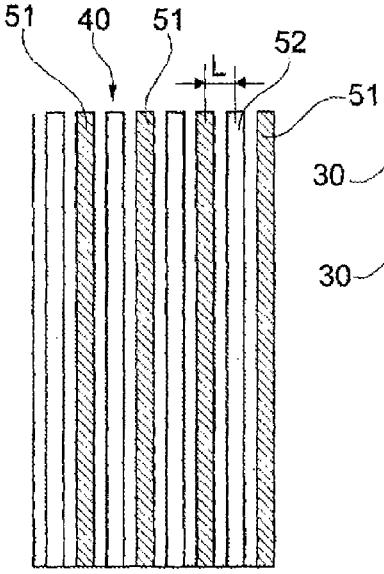
FIGS. 12 and 13 show the production of the optically variable zones by printing.

For example, for one direction of observation a black color on zone 31 alone is observed, as shown in FIG. 10, and for another angle of observation, the appearances of the zones 31 and 32 are reversed, as shown in FIG. 11.

Figure 8:
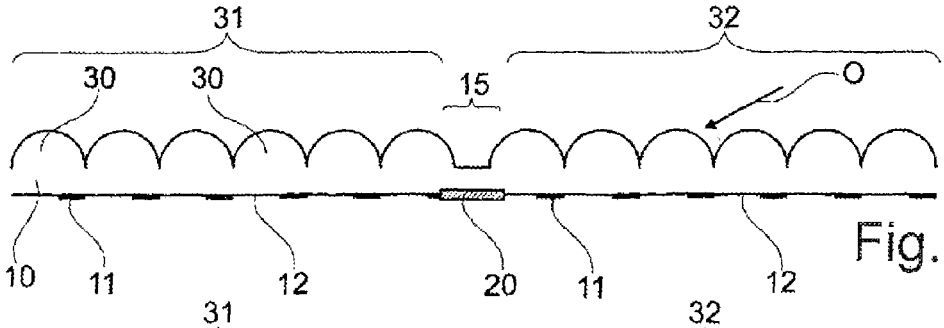
FIGS. 8 and 9 show an alternative embodiment of the optically variable zones.
Figure 9:
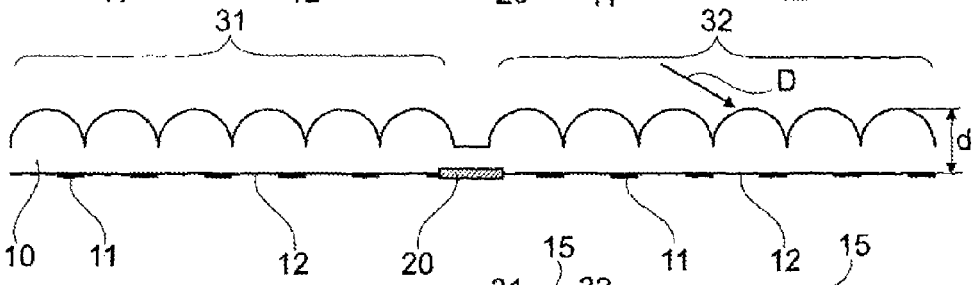

FIG. 10 corresponds to the appearance for an observation in direction O of FIG. 8, and FIG. 9 to the appearance in the direction of observation D in FIG. 9.

The first and second pattern or color may be at least partially identical.

"Same pattern" means a single pattern or image which may have several occurrences, of which the appearance, that is to say the shape, appearance and/or color, is substantially the same or at least partially identical. For example, the pattern has the form of an alphanumeric symbol or is representative of a symbol, a logo, a person, a landscape, an object, etc.

According to an exemplary embodiment, disjointed pattern elements 11 are each positioned facing a corresponding lens 30. In the first zone 31, each pattern element 11 is placed on a first side with regard to the center or the axis of the corresponding lens 30, and each pattern element in the second zone 32 is placed on a second side, opposite the first side, with regard to the center or the axis of the corresponding lens.

Thus, in the first zone 31, each pattern element 11 is placed in the same way with regard to the corresponding lens 30. In particular, the pattern elements 11 may be distributed in the same way as the corresponding lenses 30, that is to say, with the same spacing pitch and without angular shift, so as to avoid any moiréeffect.

Furthermore, a single pattern element 11 is placed opposite a corresponding lens 30. Hence, each lens 30 is associated with a single pattern element 11 to make the pattern element appear or disappear. In particular, it is possible to avoid placing a plurality of pattern elements 11 opposite a single lens 30. It is also possible to avoid placing a plurality of partial images constituting an interlaced image opposite a single lens to generate complex optical effects that are difficult to distinguish.

The pattern elements 11 may be obtained by perforations, deposits and/or voids in the material. For example, the pattern elements 11 are obtained by a metallization or a demetallization of materials selected from: metals, metal compounds, alloys, metallic varnishes or inks, as described in document EP 279880. Alternatively, the pattern elements 11 may be obtained by selective printing, in positive or negative, of an ink containing pigments selected from: carbon black pigments, magnetic pigments, colored pigments, pigments visible under UV or IR radiation or a mixture thereof According to an exemplary embodiment, the distance between the lens array and each pattern element 11 is shorter than or equal to the focal length of the lenses 30 of the lens array. The distance between the apex of each lens 30 and the pattern element 11 is preferably longer than the radius of curvature at the center of the lens.

In the case of the example of a frustoconical hemispherical lens, also called "plane-convex lens", that is to say, resulting from the combination of a planar diopter and a spherical diopter, the radius of curvature at the center of a lens, the height and the radius of the lens are related by the following known formulas:

$$H(2R_c-H)=r^2 \text{ OR}$$

$$H=R_c\sqrt{(R_c^2-r^2}$$

where $R_c$ is the radius of curvature at the center of the lens, H the height of the lens and r the radius of the lens at the level of the planar diopter.

The height of a lens may therefore be determined from the radius of curvature and the diameter of the lens. Thus, a compromise can advantageously be found between the thickness of the security element and the resolution of the pattern.

A satisfactory compromise between thickness and resolution is preferably obtained for a lens array in which the lenses 30 have a diameter between 15 and 50 microns for a radius of curvature between 10 and 40 microns. For example, for a lens array in which the lenses have a diameter of 20 microns, for a radius of curvature of 15 microns, the pattern elements 11 are preferably located at a distance of between 20 and 30 microns from the apex of the lenses. For example, for a lens array in which the lenses have a diameter of 50 microns for a radius of curvature of 30 microns, the pattern elements are preferably located at a distance of between 25 and 45 microns.

Preferably, each pattern element 11 is located on one face of the support 10 opposite a corresponding lens 30, so as to have a width at least equal to the radius of the corresponding lens. This arrangement serves to make the pattern element 11 appear and disappear suitably, that is to say, the time of appearance is substantially equivalent to the time of disappearance when the observer varies the angle of observation of the security thread uniformly over time.

With the arrangement defined above, the security thread has a reduced thickness while preserving an effect of appearance and disappearance that is particularly effective for incorporation into security documents, and even for relatively thin documents such as banknotes. Since banknotes generally have a thickness of about 100 microns, the security threads they carry must therefore not exceed approximately this thickness.

For example, a security thread according to the invention may have a lens array comprising a set of identical frustoconical hemispherical lenses 30, having a diameter of about 50 microns, for a radius of curvature of 30 microns and a height of about 14 microns. In this case, as explained above, the distance d between the apex of the lenses 30 of the lens array and the corresponding pattern elements 11 may be between 25 and 45 microns, for example equal to the radius of curvature at the center of the lenses of the lens array. In consequence, the thickness of the security thread thus obtained is about 30 microns, which is particularly suitable for incorporation into a security document such as a banknote. Furthermore, the diameter of 30 microns of the lenses gives rise to a completely satisfactory pattern resolution for authentication and identification. Finally, the inscription of a pattern element covering an area corresponding to about half of the area of a lens implies a pattern element width of about 15 microns, making it possible to avoid complex and costly inscription processes like those used by means of a laser for very high resolutions, for example for printing a complete pattern behind each lens as in the case of a magnifying moiréeffect.

Each pattern element 11 may be formed on the security thread by metallization and/or demetallization, for example in aluminum. Metallization/demetallization processes offer a fineness and a definition such that they are difficult to reproduce by printing. The pattern elements 11 may even be inscribed by a printing method such as offset, intaglio, laser, inkjet, microlithography, rotogravure or by screen printing, being inscribable in positive or in negative.

The pattern elements 11 may consist of points having optical light diffraction properties which are placed on a mirror-type reflecting surface so as to have a high contrast with regard to the surface. The points constituting the pattern elements may be achromatic, that is to say that they are not decomposed by white light, and may be placed on a non-achromatic surface.

Alternatively, the pattern elements 11 may be printed with colored inks or not, visible to the naked eye or not, for example inks visible only under ultraviolet or infrared light, opaque, fluorescent, phosphorescent, thermochromic, photochromic, translucent and/or transparent, etc. In the case of a visible printing, the light source used to illuminate the security thread is for example ambient light originating from the sun or an artificial light. In the case of an ink revealed under excitation by a given wavelength, the appropriate lighting device will be used.

In the example in FIGS. 8 to 11, the lens array consists of a set of hemispherical lenses 30 which are positioned coplanarly on the face 19 of the support 10 and arranged in lines or offset columns. For example, the lens array is formed of a plurality of lenses 30 placed adjacent to one another to form a column of joined lenses. This column of lenses 30 is itself adjacent to another column of lenses, the columns of lenses being themselves placed in an offset manner to one another, for example with an offset of about one hemispherical lens radius along the longitudinal direction of the lens column. This zigzag arrangement of the lenses allows optimal compacting of the lenses on the face 19 of the support 10, which has the effect of increasing the total resolution of the pattern for more effective authentication of the security element. The pattern elements 11 are printed or made otherwise on the face 12 of the support 10.

A third security element 20 extends on the face 12, between the zones 31 and 32 provided with lenses 30, when the thread is observed from the front.

Figure 24:
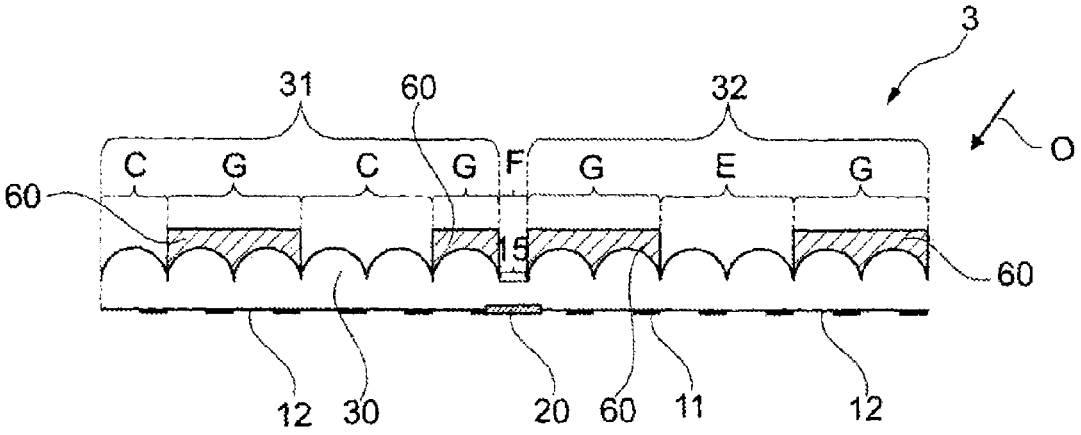
FIGS. 24 and 25 show a cross section of an alternative embodiment of the optically variable zones.
Figure 25:
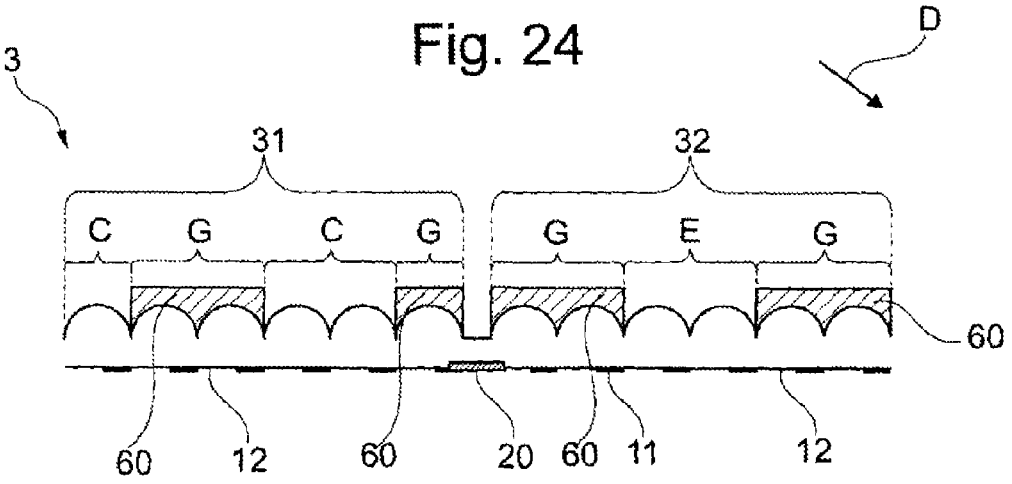

In FIGS. 24 and 25, the lenses are covered by the variable-opacity element 60, for example, deposited by printing. In particular, the ink is deposited where the higher-opacity zone G must be formed.

A first pattern or color may be observable through the lens array along a first angle of observation in the first zone C, a second pattern or color observable through the lens array along a second angle of observation, different from the first angle, in the second zone E.

Figure 26:
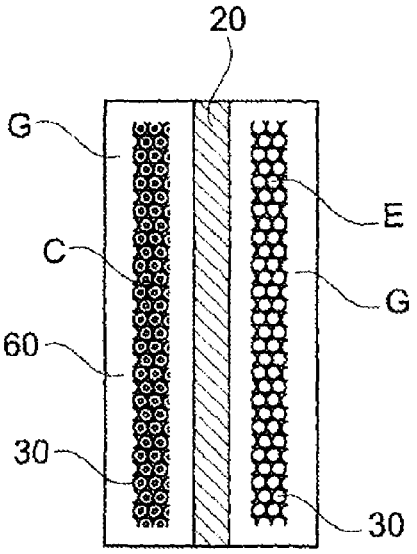
FIGS. 26 and 27 show the change in appearance of the optically variable zones of the embodiments in FIGS. 24 and 25 with the modification of the direction of observation.
Figure 27:
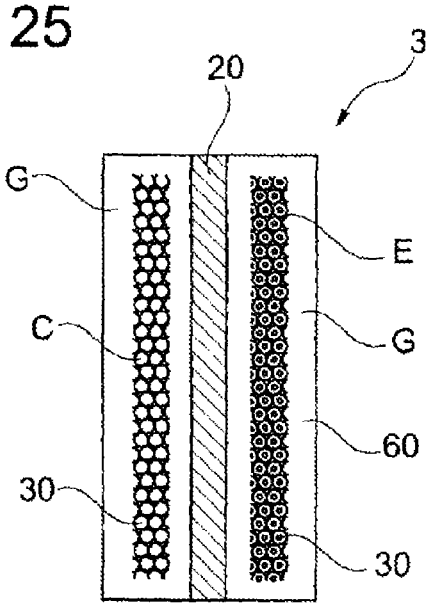

For example, for one direction of observation, a black color is observed on zone C alone, as shown in FIG. 26, and for another angle of observation, the appearances of the zones C and E are reversed, as shown in FIG. 27.

In these examples in FIGS. 24 to 27, the third security element 20 is visible between the two optically variable elements.

A security document 1 according to the invention comprises at least one security thread 3 as described above, constituting what is called a "first level" security element.

Figure 28:
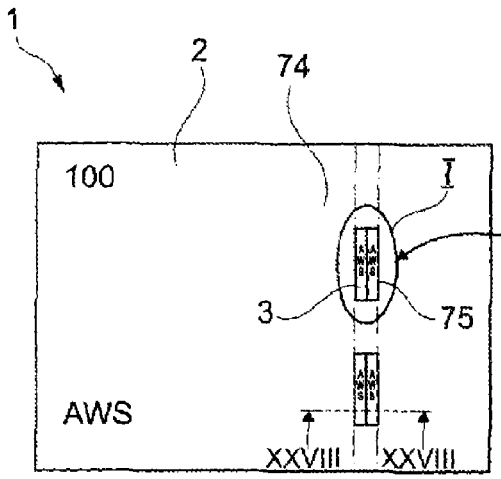
FIG. 28 shows a front view of a security document in an exemplary embodiment of the invention.
Figure 29:
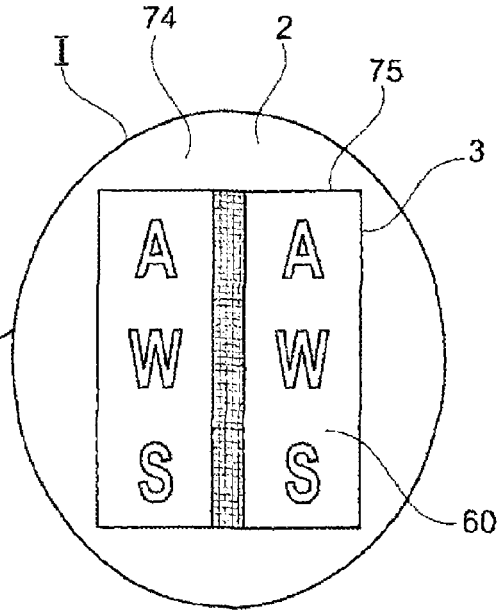
FIG. 29 shows detail I of the security document in FIG. 28, at higher scale.
Figure 30:
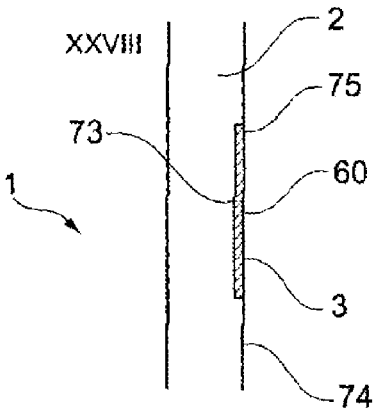
FIG. 30 shows a cross section along XXVIII-XXVIII of FIG. 28, illustrating the window positioning of the security thread in the security document.

FIGS. 28 and 29 show a security document 1, for example a banknote, in which a security thread 3 is inserted in a window, as shown for example in FIG. 17. FIG. 30 shows a cross section along XXVIII-XXVIII defined in FIG. 28. At least part of the security thread 3 is visible through a window 75, in which it is flush with the surface of the document as shown in FIG. 30. The security thread is positioned so that one face 73 of the substrate 2 supports the opposite face of the variable-opacity element 60. In this way, the first and second optically variable elements are only observable, in reflected light, from the face 74 of the document on which the variable-opacity element 60 is visible.

In the case of an incorporation in windows, as in the example in FIG. 28, the surrounding higher-opacity zone G preferably has a uniform color substantially identical to the color of the adjacent portion of the face 74 of the document on which the security thread appears. The borderline between the security thread 3 and the security document 1 is thus not clearly visible to an observer, and only the lower-opacity zones clearly change appearance when the direction of observation changes.

Figure 31:
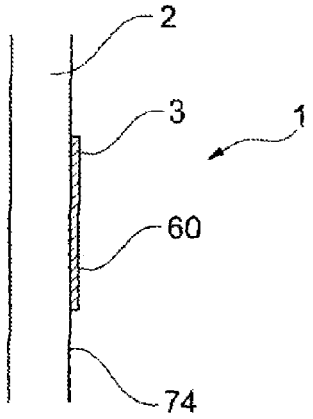
FIG. 31 shows an alternative surface positioning of the security thread.

As shown in FIG. 31, the security thread 3 may also be placed on the surface of the security document 1. The security thread 3 is positioned so that the variable-opacity element 60 is turned toward the observer.

For a direction of observation O, for which one of the optically variable elements appears transparent, the color of the substrate 2 or of a pattern printed on the face 74 and located under the lower-opacity zone C or E is visible through the variable-opacity element 60. For a direction of observation Q, the reflecting appearance of the flake particles is observed in reflection in zones C or E.

The thread or the document may however comprise other "first level" security elements and/or at least one "second level" and/or "third level" security element.

The document 1 may in particular comprise the following security elements, alone or in combination:

dyes and/or luminescent pigments and/or interference pigments and/or liquid crystal pigments, in particular in printed form or mixed with at least one component layer of the document, components, dyes and/or photochromic or thermochromic pigments, in particular in printed form or mixed with at least one component layer of the document, an ultraviolet (UV) absorber, in particular in coated form or mixed with at least one component layer of the document, a specific light-collecting material, for example of the "waveguide" type, for example a luminescent light-collecting material like the polycarbonate base polymer films sold by BAYER under the trade name LISA, a multilayer interference film, a structure having variable optical effects based on interference or liquid crystal pigments, a birefringent or polarizing layer, a diffraction structure, an embossed image, means producing a "moiréeffect", such an effect capable for example of causing to appear a pattern produced by the superposition of two security elements on the document, for example by bringing lines of two security elements closer together, a partially reflecting refractive element, a colored filter, another metalized foil, goniochromatic or holographic, a layer having a variable optical effect based on interference or liquid crystal pigments, a flat security element having a relatively small format such as a planchet, visible or nonvisible, in particular luminescent, with or without electronic device, particles or aggregates of particles of pigments or dyes, type HI-LITE, visible or nonvisible, in particular luminescent, security fibers, in particular metallic, magnetic (with soft and/or hard magnetism), or absorbent, or excitable to ultraviolet, visible or infrared, and in particular the near infrared (NIR), an automatically legible security having specific and measurable luminescence properties (for example fluorescence, phosphorescence), of light absorption (for example ultraviolet, visible or infrared), of Raman activity, magnetism, microwave interaction, interaction with X-rays or electrical conductivity.

One or more security elements as defined above may be present in the document and/or in one or more component layers of the document or in one or more security elements incorporated into the document and/or into one or more component layers of the document, as for example a thread, a fiber or a planchet.

At least one of the component layers of the document may also comprise a first level security element such as a watermark or a pseudo-watermark at least partially superposed on a translucent region of the document.

A security thread 3 according to the invention may be made from a film 40. The first optically variable element is made on the film in the form of spaced parallel strips 51 and the second optically variable element is made in the form of spaced parallel strips 52, interlaced with the strips 51 formed by the first element, with a spacing between the strips of the first element and the strips of the second element. The film is cut at mid-width of the strips of the first element and the strips of the second element to constitute a plurality of security threads 3.

The strips 51 and 52 have a width between 3 and 5 mm for example.

Two strips 51 and 52 are for example spaced by a distance of 0.5 mm.

Figure 13:
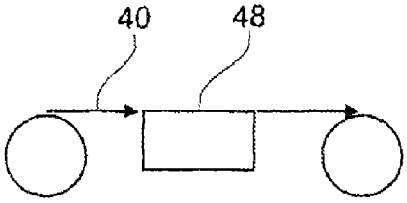

The deposition of the pigment layers 16, 17 or the formation of the lenses 30 can be achieved by passing the film through a printing station 48, as shown in FIG. 13.

The film 40 is for example unwound a first time before passing through the printing station 48, to form strips 51 corresponding to the pigment layers 16. The film 40 is then turned over, for example by rotation about an axis perpendicular to the film surface, and reintroduced into the machine to form strips 52 corresponding to the pigment layers 17. Because of the overturning, the pigments of the layers 16 and 17 are oriented differently on the thread. The film is then cut to form the threads which are wound on multiple spools.

The invention is not limited to the examples shown.

The security document including the security thread may further be a document such as a passport, an identity card, a driver's license, a playing card or an interactive collection card, a means of payment other than a banknote, in particular a payment card, a purchase voucher, a transport card, a loyalty card, a service card or a subscription card.

Particular embodiments of the examples described can be combined in alternatives not shown.

The thread may be made by employing the teachings of patent FR 2 877 609 B1 or of application WO 2004/106078 A1.

For example, the thread may comprise:

at least one first fluorescent zone capable, in a predefined lighting condition, of emitting by fluorescence a visible light from a first layer, at least one second fluorescent zone capable, in the predefined lighting condition, of emitting by fluorescence a visible light of a second color, different from the first, the first and second fluorescent zones respectively being observable from the opposite faces of the thread.

The third security element may constitute one of the fluorescent zones and the other fluorescent zone may be made in the intermediate zone.

Advantageously, the first and second fluorescent zones are superposed at least partially in order to constitute the third security element and in such a way that, in the predefined lighting condition, the superposition of the two fluorescent zones appears in transmitted light of a third color, different from the first and second colors.

The authentication and/or identification of an article or document incorporating such a thread may comprise two steps of observation, in the predefined lighting condition, of the first and second colors in reflection, at least one step of observation in transmitted light to observe the third color.

For example, under UV lighting, in reflection, the first fluorescent zone appears yellow and the second fluorescent zone blue and, observed in transmitted light, the thread has a violet color when observed from a first face and appears substantially white when observed from a second face, opposite to the first.

Furthermore, the printings placed respectively on each side of the intermediate zone under each of the optically variable zones, made for example by means of lens arrays or reflecting particles, may also be fluorescent and may represent patterns. Thus, the two additional steps of observation of the security thread along different angles make fluorescent colors, preferably different, appear in reflection on each side of the intermediate zone. These colors may also be different from the color visible in reflection in the intermediate zone.

The third security element may comprise a security pattern consisting of a first pattern formed from substances having an interference effect and a second pattern formed from substances reacting to certain stimulations, such as light radiation or heat, magnetic, electromagnetic, electric or microwave stimulation, and producing a light response visible to the human eye or a specific signal detectable using a suitable apparatus.

A simple and particularly attractive technical solution is to apply to a paper or plastic substrate a layer consisting of a proportional mixture of the two substances: the two patterns are in this way completely identical and represent the same final security pattern. Advantageously, the first pattern appears in white light and the second pattern appears under stimulation, the two patterns being identical, and the observer has the impression of viewing the transformation of a pattern, which is particularly effective in terms of authentication.

This layer may advantageously be applied by printing, in particular by rotogravure or by screen printing, and consists of a proportional mixture of the substances reacting to certain stimulations, such as light radiation or heat, magnetic, electromagnetic or electric stimulation, by producing a light response visible to the human eye or detectable by a suitable apparatus.

Another technical solution is to apply to the security document, in succession, a layer comprising substances having an interference effect, thereby forming a first security pattern, and a layer comprising substances reacting to certain stimulations, such as light radiation or heat, magnetic, electromagnetic or electric stimulation, by providing a light response visible to the human eye or detectable by a suitable apparatus.

These two patterns can accordingly either be identical, thereby retrieving the result obtained by the application of a single layer, or partially superposed, or contiguous, or even completely disjointed, culminating in a composed final pattern.

From this standpoint, it may be advantageous to provide a final pattern of the alphanumeric type, in which part of the signs or letters is formed by the first pattern and the other part of said signs or letters is formed by the second pattern.

Under normal observation, that is to say, in white light, the final pattern is illegible, the letters or signs being half truncated, for example. On the contrary, under the action of external stimulation, such as a temperature rise for example, the final pattern appears in its entirety.

It is thus feasible to provide a final pattern of the alphanumeric type, in which certain signs or letters are formed by the first pattern and certain other signs or letters are formed by the second pattern.

Under normal observation, that is to say in white light, the final pattern, in this way, has a uniform interference effect according to the first pattern, the second pattern then being invisible. On the contrary, under the action of external stimulation, such as a light emitting an ultraviolet radiation for example, the second pattern of the alphanumeric type is revealed during the stimulation.

The security thread may further comprise:

at least one first fluorescent composition, at least one second phosphorescent composition, the first and second compositions being excitable simultaneously by a predefined illuminant from the same face of the structure.

The two compositions may constitute the third security element.

The first fluorescent composition may be superposed, at least partially, on the second phosphorescent composition.

One of the first and second compositions may form a flat which is superposed on the other of the first and second compositions, which forms at least one pattern.

One of the first and second compositions may form at least one pattern which, upon the extinction of the lighting by the predefined illuminant, appears or disappears, or which changes appearance by passing from a positive or negative pattern or from one color to another.

The first fluorescent composition may, under the lighting by the predefined illuminant, emit a visible light of a first color, the second fluorescent composition, under the lighting by the predefined illuminant, emitting a visible light of a second color, different from the first, and at least one zone of superposition of the first and second fluorescent and phosphorescent compositions, under lighting by the predefined illuminant, emitting a visible light of a third color, resulting from the additive synthesis of the first and second colors.

The expressions "comprising a" or "comprising one" are synonymous with "comprising at least a" or "comprising at least one".

What is claimed is:

1. A security thread having a longitudinal axis, said thread configured to be incorporated into a security document, comprising:

at least two zones located respectively on either side of a separation line extending along a direction parallel to the longitudinal axis;

a first optically variable security element in the first zone; and a second optically variable security element in the second zone, the first and second zones and the first and second elements each being at a distance from the separation line, a neutral zone being defined between said first and second security zones, the first and second security elements being arranged so that for a first direction of observation, the first and second elements have different appearances from one another and for a second direction of observation, different from the first direction of observation, the first and second elements have:

a changed appearance relative to an appearance when observed along the first direction of observation, and different appearances from one another, wherein the security thread comprises a third security element extending along a direction parallel to the longitudinal axis of the security thread, the third security element being located at least partially within the neutral zone, when the thread is observed from the front.

2. The thread as claimed in claim 1, the separation line being a median line.

3. The thread as claimed in claim 1, the third element having a first, second or third level security feature.

4. The thread as claimed in claim 1, the third element being at least partially superposed with one of the first and second optically variable elements, when the security thread is observed from the front.

5. The thread as claimed in claim 1, the third element extending continuously or discontinuously along a strip.

6. The thread as claimed in claim 1, the third element being placed on one side of a support and the first and second elements being placed on the opposite side of the support.

7. The thread as claimed in claim 6, the support being made from a thermoplastic material.

8. The thread as claimed in claim 1, the first and second security elements comprising the same pigment, which is deposited differently on the first and second zones.

9. The thread as claimed in claim 8, the pigment being reflecting.

10. The thread as claimed in claim 8, the pigment covering underlying printings.

11. The thread as claimed in claim 1, the third element extending visually at least partially between the first and second elements, the third element and reflecting particles being at least partially superposed.

12. The thread as claimed in claim 1, the first and second optically variable elements each comprising a lens array.

13. The thread as claimed in claim 12, pattern elements each being associated with a lens.

14. The thread as claimed in claim 1, further comprising a variable-opacity element at least partially superposed on the first and second optically variable elements, defining first and second lower-opacity zones superposed at least partially respectively with the first and second optically variable elements.

15. The thread as claimed in claim 14, the variable -opacity element being superposed with the third security element and defining a third lower-opacity zone, through which the third security element is visible.

16. The thread as claimed in claim 14, the area covered by the first and second lower-opacity zones being less extensive than the area covered by the surrounding higher-opacity zone.

17. The thread as claimed in claim 14, the variable-opacity element comprising a pixelated image, when observed in transmitted light.

18. The thread as claimed in claim 14, in which, when observed along the first direction of observation through the first and respectively the second lower-opacity zone, the first and respectively the second optically variable element appears to be transparent and respectively reflecting, and when observed along the second direction of observation different from the first, the first and respectively the second optically variable element appears to be reflecting and respectively transparent.

19. The thread as claimed claim 14, the superposition of the higher-opacity zone with the first and second optically variable elements respectively defining fourth and fifth optically variable zones, so that when observed along the first direction of observation, respectively along the second direction different from the first, the fourth optically variable zone, respectively the fifth zone, has a different visual appearance from the fifth zone, respectively from the fourth zone and in particular appears to be lighter, respectively darker.

20. The thread as claimed in claim 1, the surrounding higher -opacity zone being discontinuous, in particular in the form of a pixelated image or raster.

21. A security document incorporating a security thread as claimed in claim 1, the thread extending from one edge of the document to an opposite edge.

22. The document as claimed in claim 21, the security thread being placed in one or more windows.

23. The document as claimed in claim 21, the security thread being placed on the surface.

24. A method for fabricating a thread, in which a first optically variable element is made on a film in the form of spaced parallel strips and a second optically variable element is made in the form of spaced parallel strips, interlaced with the strips formed by the first element, with a spacing between the strips of the first element and the strips of the second element, the film being cut at mid-width of the strips of the first element and the strips of the second element in order to constitute a plurality of security threads, each security thread of said plurality of security threads having a longitudinal axis and comprising:

at least two zones located respectively on either side of a separation line extending along a direction parallel to the longitudinal direction;

a first optically variable security element in the first zone; and a second optically variable security element in the second zone, the first and second zones and the first and second elements each being at a distance from the separation line, a neutral zone being defined between said first and second security zones, the first and second security elements being arranged so that for a first direction of observation, the first and second elements have different appearances from one another and for a second direction of observation, different from the first direction of observation, the first and second elements have:

a changed appearance relative to an appearance when observed along the first direction of observation, and different appearances from one another, wherein the security thread comprises a third security element extending along a direction parallel to the longitudinal axis of the security thread, the third security element being located at least partially within the neutral zone, when the thread is observed from the front.

25. The method as claimed in claim 24, the strips being made during a first passage in front of a print head, the film is then turned over and the strips are made during a new passage in front of the print head, the change in appearance of the strips during the change in the direction of observation being associated with said overturning of the film during the fabrication.

* * * * *